United States Patent [19]

Elmer et al.

[11] Patent Number: 4,569,003

[45] Date of Patent: Feb. 4, 1986

[54] INTERIOR INDIRECT LIGHTING

[76] Inventors: William B. Elmer, 2 Chestnut St., Andover, Mass. 01810; Thomas M. Lemons, 72 Loring Ave., Salem, Mass. 01970

[21] Appl. No.: 636,693

[22] Filed: Oct. 19, 1984

[51] Int. Cl.[4] ..... F21S 1/02; F21S 3/02

[52] U.S. Cl. ..... 362/147; 362/432

[58] Field of Search ..... 362/147, 347, 432

[56] References Cited

U.S. PATENT DOCUMENTS 1,780,125 10/1930 Goodhouse ..... 362/147

1,900,436 3/1933 Dourgnon ..... 362/290

FOREIGN PATENT DOCUMENTS 547329 12/1922 France ..... 362/147

*Primary Examiner*—Ira S. Lazarus

*Attorney, Agent, or Firm*—Charles Hieken

[57] ABSTRACT

An indirect room lighting system has a diffuse reflecting upper band around the walls about 15 to 24 inches high. A luminaire illuminates this diffuse reflecting band with a beam of light having a radiation pattern broad horizontally and narrow vertically confined essentially to the region of the diffuse reflecting upper bands. The reflector of the luminaire may be positioned at a 45° angle to the walls in the corner, intersecting in the corner, or in the center of the room comprising a Fresnel cylindrical lens, or it may take other forms.

14 Claims, 15 Drawing Figures

INTERIOR INDIRECT LIGHTING

The present invention relates in general to interior lighting and more particularly concerns novel apparatus and techniques for efficiently indirectly lighting building interiors in a manner that provides effective illumination while contributing to efficient temperature control of the interior.

The interior rooms of buildings in general are conventionally illuminated by ceiling-mounted or wall-mounted luminaires in sufficient numbers to provide direct illumination of the interiors. Indirect lighting systems are also in common use in which suspended or floor-standing luminaires illuminate a white ceiling which in turn indirectly illuminates the room interior. Past experience and recent lighting research show that visual efficiency and worker productivity are maximum, relative to the quantity and quality of light used when the light enters the room from upper wall locations. Tests of lighting quality which have evaluated methods to enhance task contrast in terms of equivalent sphere illumination, (ESI) values, have shown that upper wall illumination is more effective per unit of light flux than any other location from which light may be directed upon tasks. Tests of the response of workers to their environment and their resultant productivity have shown that both are enhanced when their surrounding vertical surfaces are illuminated.

It is an important object of this invention to provide improved interior indirect illumination.

According to the invention, a source of light directs a beam of light upon high reflectance strips or bands located generally along the upper walls of the room. More particularly, horizontally aimed luminaires with high efficiency light sources and reflecting means for directing light energy in a beam having a broad horizontal angular width significantly greater than a narrow vertical angular width project light upon the white or other colored diffuse bands of reflcting surfaces in the upper wall level of interior spaces so that most of the light strikes and is confined to the reflecting bands for reflection therefrom to provide general illumination for the room.

According to another form of the invention, a single light source is located centrally in a room and optically controlled by a surrounding cylindrical lens whereby the combination of the light source luminous output and source size with the lens focal length projects a narrow vertical beam throughout a 360° arc upon all the upper wall surfaces which then reflect the light back into the room. It is within the principles of the invention to form the illumination system with combinations of wall mounted reflector optics units and a centrally located cylindrical lens unit. Further alternatives include combinations of optical elements using reflectors and lenses in combination to produce the narrow vertical and wide horizontal beams of light.

Numerous other features, objects and advantages of the invention will become apparent from the following specification when read in connection with the accompanying drawings in which.

Figure 1:
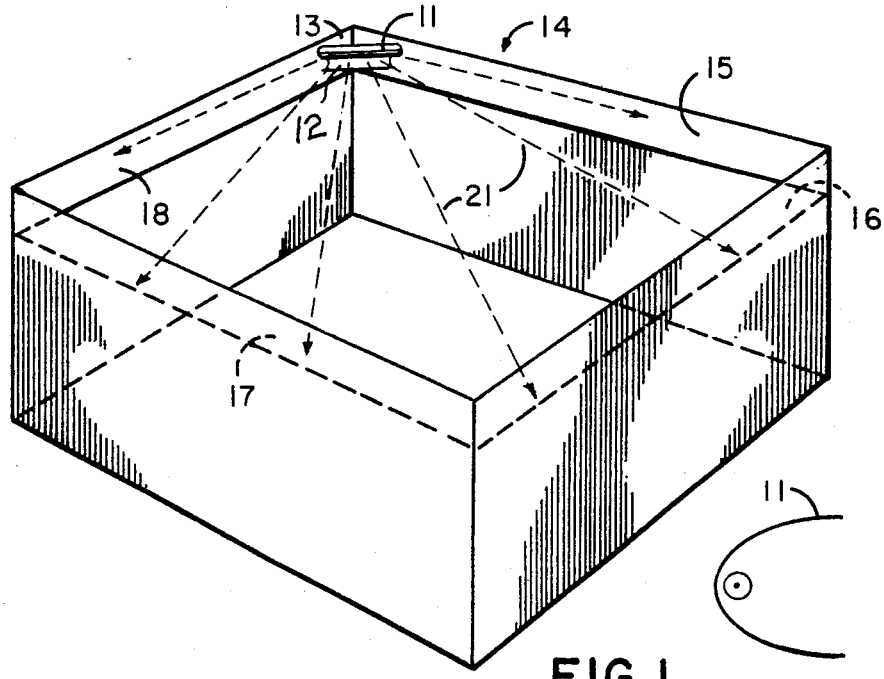
FIG. 1 is a diagrammatic perspective view of an embodiment of the invention in which a single corner luminaire illuminates the upper walls of the room.

With reference now to the drawings and more particularly FIG. 1 thereof, there is shown a diagrammatic representation of an embodiment of the invention in which a single luminaire 11 with a parabolic or elliptical reflector 12 is positioned diagonally in a corner 13 near the ceiling of room 14 having four white diffuse bands, typically about 15 to 24 inches high, 15, 16, 17 and 18 at the top of each wall that receive the direct rays 21 from parabolic or elliptical luminaire 11. Luminaire 11 is mounted at a 45° angle with respect to the walls to provide a strong pancake-shaped beam throughout the upper level of room 14, striking all four reflecting bands relatively equally, thereby fully illuminating the room indirectly from all four sides in the most visually effective manner.

This system thus provides the best lighting of an entire room from a single relatively inexpensive luminaire. The system leaves the entire ceiling free and clear of hanging luminaires or expensive ceiling mounted troffers. A single electric connection is all that is needed for the entire room, thereby resulting in low initial cost, operation and maintenance. The single large luminaire required is typically of higher efficiency than several smaller lamps, thereby further enhancing the economy of the system.

The invention results in the heat from the single large lamp being confined to one corner of the room, preferably the outside corner of the room to facilitate easily venting heat from the lamp in hot weather, or alternatively distributing or piping it appropriately for heating utilization in cold weather, thereby solving one of the serious temperature control problems caused by conventional lighting systems, especially in large buildings.

The advantages of the invention may be achieved while maintaining uninterrupted lighting by installing two corner luminaires without incurring objectionably increased first cost, while retaining all the overwhelming advantages of the invention. When one lamp in one corner becomes inoperative, the lamp in the other corner may be illuminated. If desired, the standby lamp may include a switch that turns the lamp on when sensing that the main lamp is extinguished.

Figure 2:
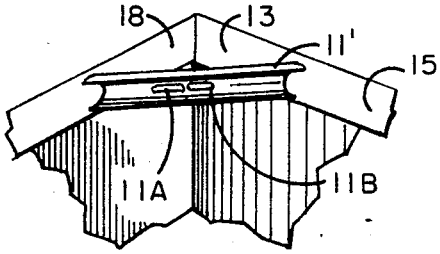
FIG. 2 is a fragmentary view of an alternative embodiment of the invention using a longer corner reflector set further into the room than with the embodiment of FIG. 1.

Referring to FIG. 2, there is shown a fragmentary view of corner 13 using a larger luminaire 11' having two lamps 11A and 11B. This longer corner reflector luminaire allows room for two lamps side by side on the focal axis of the reflector to provide continuity of illumination when one lamp fails, and by its position further into the room, the angle of light incidence on the two adjacent walls of the room is greater, thereby increasing the brightness of the adjacent walls to a level more nearly approaching that of the two farther walls. The embodiment shown in FIG. 1 is fully satisfactory for all general moderate-sized room applications where uniform brightness of the upper wall band is not critical. Lack of uniformity of brightness among the four strips 15–18 is not at all necessary for satisfactory visibility within the room. With only two upper walls well illuminated, the result is equal to normal daytime lighting from windows in a corner room having windows on two sides only of the room, and is better than that in any schoolroom with windows on one side of the room only.

Figure 3:
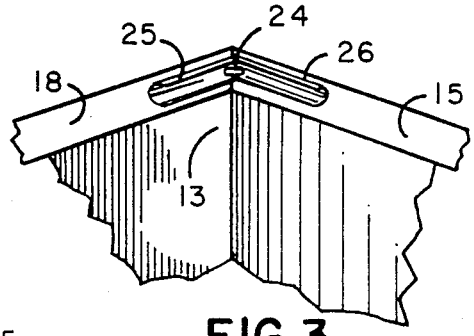
FIG. 3 is a fragmentary view of still another alternative source showing two reflectors perpendicular to each other with a single lamp at the intersection of their focus.

Referring to FIG. 3, there is shown a fragmentary view of corner 13 with another embodiment of the invention in which a single lamp 24 is located in the corner at the intersection of reflectors 25 and 26, the common focal point of the two right-angle specular reflectors 25 and 26.

Figure 4:
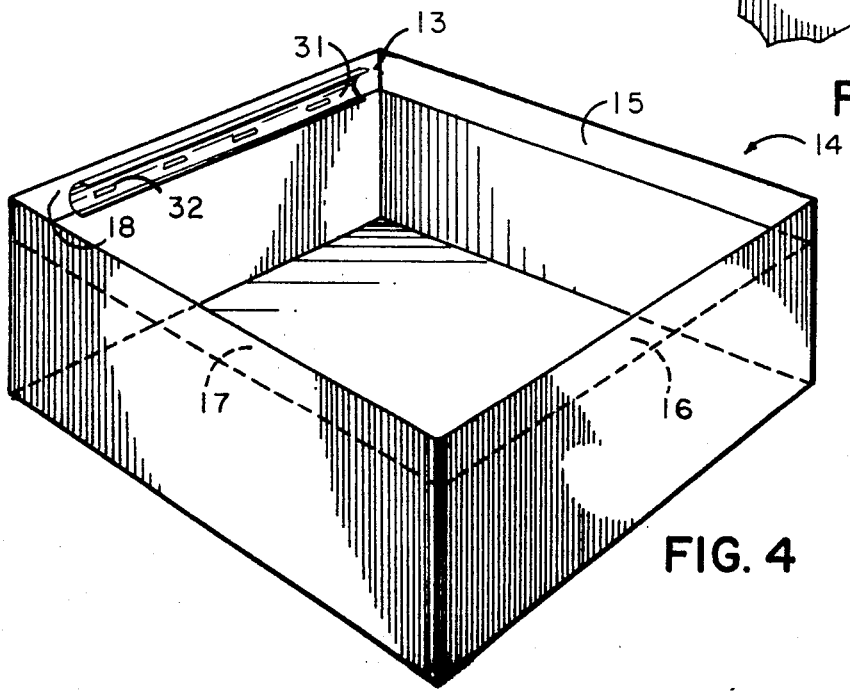
FIG. 4 is a diagrammatic representation of another embodiment of the invention in a room using a trough reflector with lamps along the focus for illuminating the upper walls.

Referring to FIG. 4, there is shown a diagrammatic representation of still another embodiment of the invention in which a specular parabolic or elliptical trough reflector 31 is located at the top of the wall with reflecting strip 18 and energized by long fluorescent or tubular lamps, or by a series of small separate lamps 32 distributed along the focal axis of reflector 31. The lamps mounted along the focal axis of long reflector 31 may be continuous fluorescent lamps, individual spaced-apart lamps 32 as shown, or a mix of lamps of different colors to realize a preferred color of light. For example, high pressure sodium lamps may be alternated with metal-halide lamps which combine a warm candelight type source with a blue daylight type source.

In very large rooms, too large to be lighted by any wall-mounted arrangement as described above, the room may be subdivided into modules of workable size, each module of which is fitted with a square white band at appropriate height above the floor and illuminated by a corner or a one-side wall fixture of the types described above.

Figure 5A:
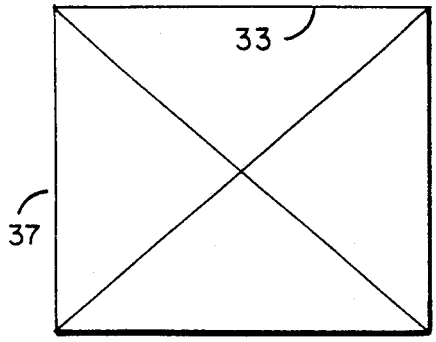
FIGS. 5A, 5B and 5C are top, side and isometric views, respectively, of a four-way modular luminaire for center or corner installation according to the invention.
Figure 5B:
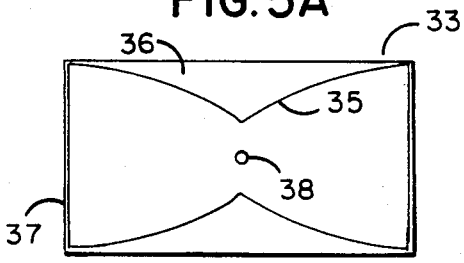
Figure 5C:
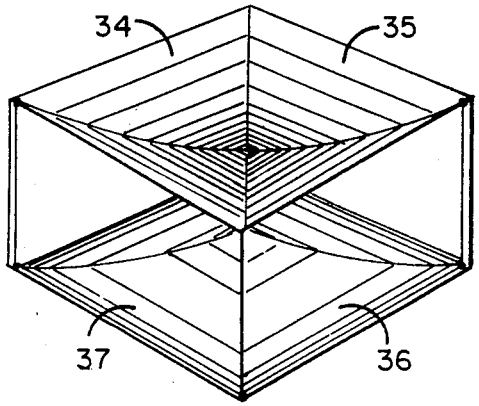

Referring to FIGS. 5A, 5B and 5C, there are shown top, side and isometric views, respectively, of a four-way modular luminaire suitable for center or corner illumination. This embodiment is especially useful in very large rooms where modules are separated completely from adjoining walls. This four-way luminaire comprises four conjoined parabolic or elliptic reflectors 34, 35, 36 and 37 arranged in a square, all four with a common focal center containing the lamp 38. Such a luminaire may be located at the common corner of four room modules if oriented at 45° with the room axes, thereby providing illumination for four modules from one single large lamp. Two of such square units installed in opposite corners of each such module would protect against the inconvenience of possible lamp failure.

This four-way luminaire 33 may be suspended from the center of a ceiling in a square room and provide extremely uniform illumination of the upper-wall reflecting band on all four sides of the room or module. Whether oriented with luminaire edges parallel with the wall, or rotated at 45° thereto, makes negligible difference in the resulting illumination and visibility within the room. A four-way luminaire 33 suspended like a chandelier in the center of a room may embody a pleasing design as well as excellent utility.

Figure 6:
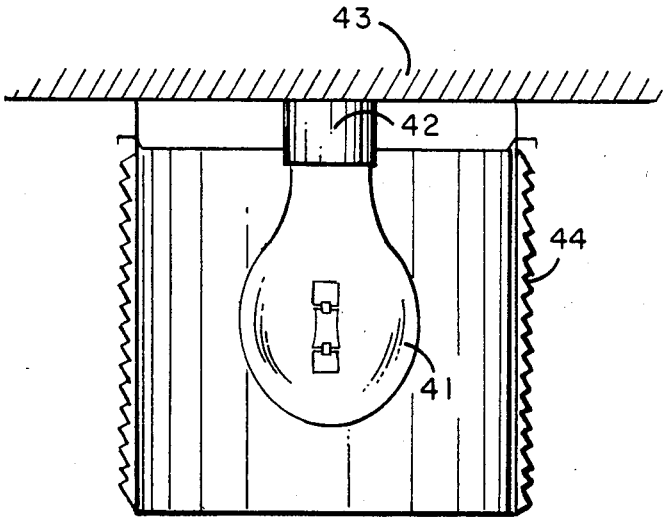
FIG. 6 is a diagrammatic representation of an embodiment of the invention for center illumination of upper wall surfaces through a cylindrical Fresnel lens.
Figure 7:
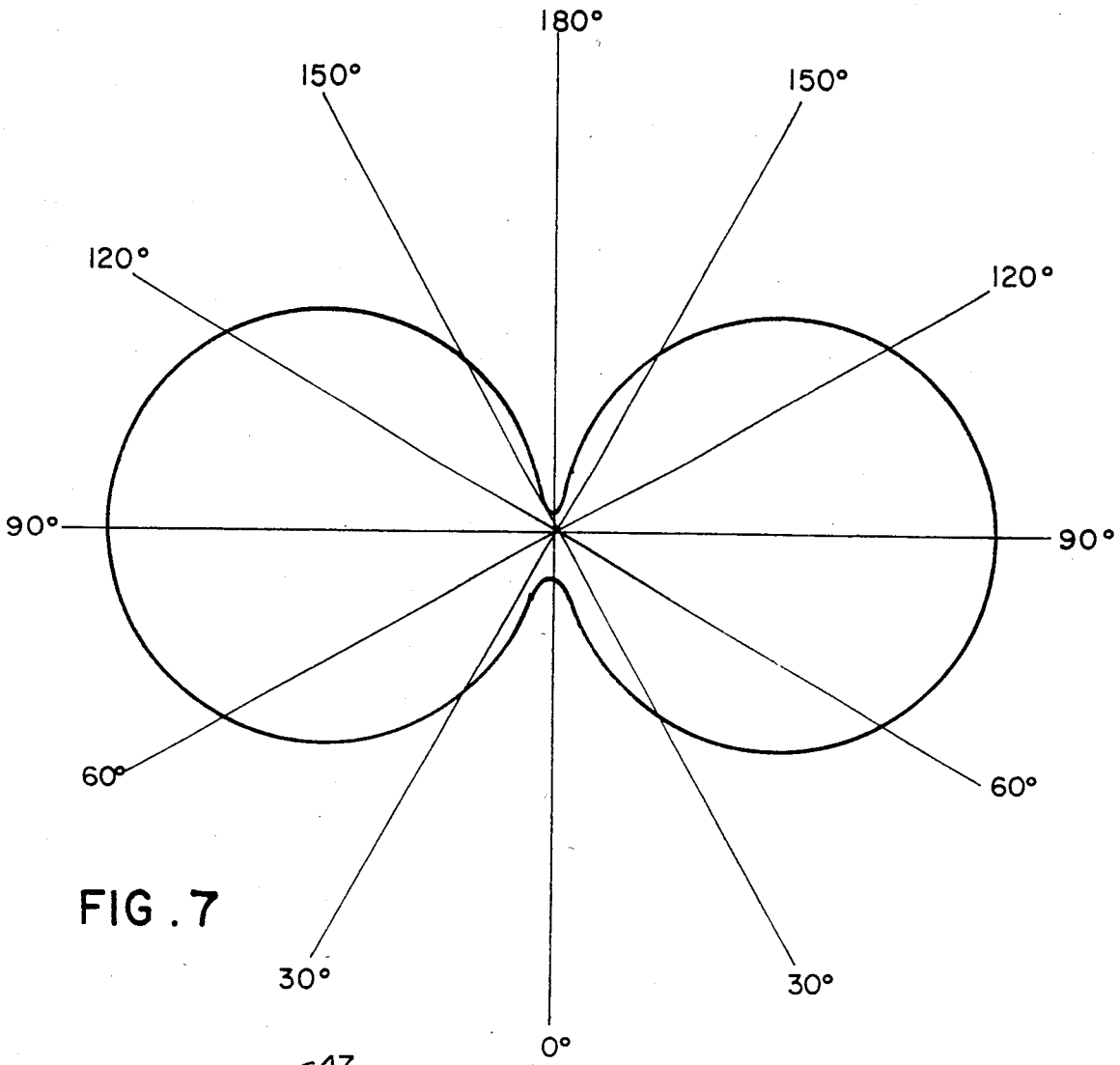
FIG. 7 is the vertical radiation distribution pattern of the lamp itself in FIG. 6.

Referring to FIG. 6, there is shown a diagrammatical representation, partially in section, of another means for illuminating a room from a single luminaire located at the center of the room. A high efficiency light source 41 is vertically mounted from a socket 42 attached to the ceiling 43 and surrounded by a cylindrical plastic Fresnel lens 44, typically two feet in diameter by two feet high. Light source 41 is preferably a high efficiency, high intensity discharge lamp having an arc typically 1–4 inches in length that radiates light substantially uniformly around the lamp as shown in FIG. 7, a graphical representation of the horizontal radiation pattern of lamp 41.

Cylindrical lens 44 typically has a focal length that is long in comparison to the size of the light source in lamp 41, efficiently collects the light from lamp 41 and produces a vertically narrow beam radiating through 360° horizontally. Lens 44 may be made of linear plastic Fresnel lens material that is now commercially available with high accuracy of the prismatic elements in lengths that can be hundreds of feet long and widths up to two feet wide. This material may be cut to the length of the circumference of a circle whose radius is equal to the lens focal length and butt sealed to form a cylinder. A typical room with a nine foot ceiling could have a two-foot diameter and two-foot high cylindrical drum illuminating the room from its center with lamp 31 located along the axis of cylindrical lens 44. If lamp 41 is raised or lowered so that the source is above or below the focal point, the beam will diverge below or above the horizontal in a manner opposite to the focal point and source location. It is thus possible to control the band of light up and down the wall within reasonable limits as well as to limit glare down into the room and increase or decrease the light spread across the ceiling.

Figure 8:
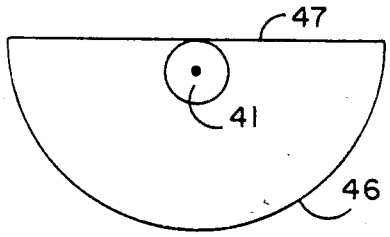
FIG. 8 is the top view of a diagrammatic representation of an embodiment of the invention using a flat mirror and semicylindrical Fresnel lens.
Figure 9:
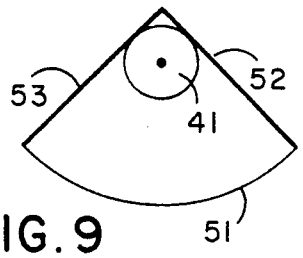
FIG. 9 is still another embodiment of the invention using two flat mirrors and a quadricylindrical Fresnel lens.

Referring to FIGS. 8 and 9, there are shown alternate embodiments of the light source of FIG. 6 using semicylindrical and quarter cylindrical plastic Fresnel lenses, respectively. Half cylinder 46 coacts with flat mirror 47 to produce a beam through 180°. Semicylindrical lens 46 produces a narrow vertical beam from the lamp 41 located near its focal point, and a slightly wider vertical beam from the reflected image of the source beyond its focal point. If the lens focal point is on the flat mirror, then the beam spread of the direct lamp image as well as the reflected image will be approximately equal.

In the embodiment of FIG. 9 using a quarter cylindrical lens 41 coacting with mutually perpendicular mirrors 52 and 53 on both sidewalls and a focal point that is between lamp 41 and its reflected image, a beam spread of about 90° will be achieved from what appears to the lens to be three light sources. As flat mirrors 52 and 53 have their included angle vary from 90° to 180°, the beam spread will correspondingly vary from 90° to 180° of lateral spread. Alternatively, in a cylindrical drum system an internal plane mirror located adjacent to the light source can modify the 360° pattern into any desirable asymmetric pattern by varying the size of the mirror which thus interrupts the light from the source to the lens in one direction and becomes a second source imaged and directed perpendicular to the mirror.

Figure 10:
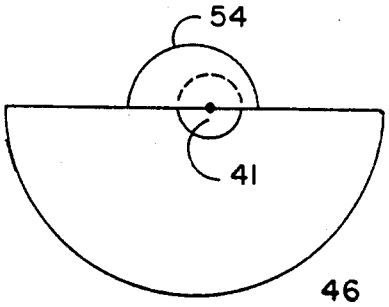
FIG. 10 is a diagrammatic representation of another embodiment of the invention using a spherical mirror and semicylindrical Fresnel lens.

Referring to FIG. 10, there is still another alternative construction of the cylindrical lens system embodying semicylindrical plastic Fresnel lens 46. By locating lamp 41 slightly to one side of the focal point of semicylindrical lens 46 and locating a spherical mirror 54 behind it and centered on the focal point of the lens as shown, the reflection from spherical mirror 54 will form a virtual image of lamp 41 beside the real source, reinforcing the source. Both real and virtual sources will be displaced by small amounts on either side of the optical center of Fresnel semicylindrical lens 46, and both images contribute to the shallow pancake beam illuminating the upper wall reflecting bands.

Figure 11:
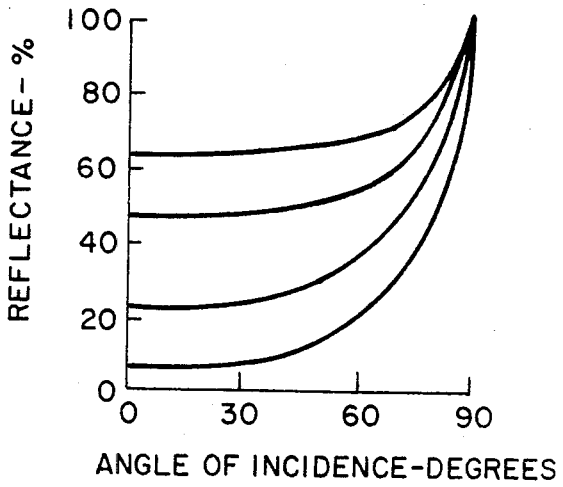
FIG. 11 is a graphical representation of reflectance of various materials as a function of angle of incidence.

With all of these systems where the luminaire is located adjacent to a flat ceiling surface, the ceiling becomes an efficient reflecting surface which adds to the light directed upon the wall, almost regardless of the surface reflectance or texture. Referring to FIG. 11, there is shown a graphical representation of reflectance of various materials as a function of the angle of incidence of illuminating light rays. All surfaces increase in reflectance as the angle of incidence increases to an angle of 90° from vertical. In a typical system, small luminaire source size, close proximity to the ceiling and large ceiling size compared to the luminaire distance from the ceiling, the angle of incidence from the luminaire to ceiling will approach 90°. Therefore, the reflectance will be high. This high reflectance increases the efficiency of light projection from the luminaire to the wall while controlling the direct glare from the luminaire because nearly all light directed upon the ceiling will be reflected upon a wall by the ceiling and not down into the room. To control reflected glare from the ceiling, the ceiling surface, especially adjacent to the luminaire, should preferably be glossy or specular. The best results can therefore be obtained in rooms with flat ceilings when the luminaire is mounted close to the ceiling, projects its main beam of light across to a wall, and transflectors or other means of limiting direct down light redirect some light upon the ceiling where it is reflected toward the walls.

The invention is applicable for schoolrooms, homes, small offices and any moderate sized room in which a failed lamp can be quickly and easily replaced without serious inconvenience.

Since none of the pancake beam extends appreciably below the reflecting strips at the top, there is no glare from it in the used areas of the room. Glare from the direct view of the light source itself may be shielded by a small transflector immediately behind the lamp which permits a small fraction of the light to pass into the room, but reflects the major portion thereof back into the luminaire. Transflectors or beam-splitters are well-known in the art and are not a part of this invention. The transflectors need only be large enough to obscure the bright light source itself from direct view within the room and will not interfere appreciably with the main beam from the luminaire.

Suppression of glare is a fundamental consideration in all lighting, and especially interior lighting. Commercial lighting uses louvers or diffusing panels for this purpose in conventional overhead lighting systems. These elements contribute heavily to the cost of such prior art systems and reduce efficiency. The illuminated upper wall bands, because of their large areas are low in brightness, need no such glare-suppressing accessories. The luminaire itself, never directed downward, can be a minor glare source that is very simple and inexpensive to control. In the case of full-width luminaires as shown in FIG. 4, the lower front edge of the parabolic or elliptical reflector 31 can be fitted with a low diffusing strip of translucent material that will also shield lamps 32 from the view of those below in the room, and also contribute to the illumination of the room from that side of the room.

Figure 12A:
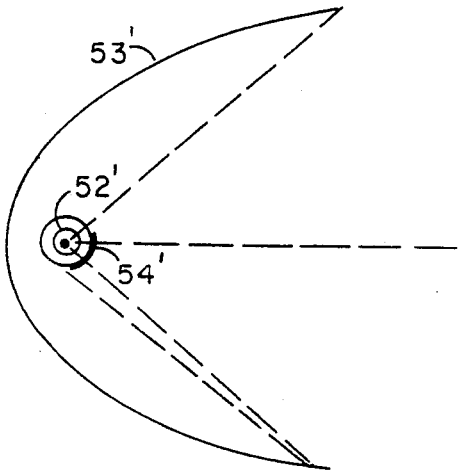
FIGS. 12A and 12B are diagrammatic representations of an aperture lamp used as a glare shield.
Figure 12B:
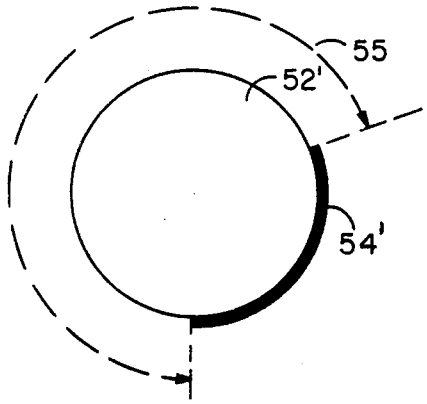

Referring to FIGS. 12A and 12B, there are shown diagrammatic representations of an aperture fluorescent lamp that illuminates the reflector surface only. FIG. 12A shows a fluorescent tube 52 mounted along the focal line of reflector 53 having a light shield 54 that allows reflector 53 to be illuminated while blocking direct light rays from fluorescent lamp 52. FIG. 12B is an enlarged view of fluorescent lamp 52 showing the large aperture indicated by the broken arc 55.

Various other means for suppressing the light glare from the lamp sources are well-known in the art, such as using partially reflectorized lamps and small shielding devices close to the lamp. One such shield is a small "spoon-shaped" shield that is clipped to the lamp bulb. Such a glare shield could be in the form of a finely perforated specular item with the net area of the perforations kept to a point at which the device appears to the eye only as bright as the indirectly illuminated upper wall bands.

The invention also contributes to solving the problem of disposing of surplus heat produced by many ceiling luminaires in large office buildings creating demands on the air-conditioning systems. Expensive and complicated combined lighting and air-conditioning systems have been developed because of this problem. The present invention, by confining the lighting heat to one or two relatively tiny areas of a room instead of distributing such heat over the entire ceiling of the room, now makes practical easy and inexpensive control of the lighting heat. A number of methods are available, depending upon the nature of the building and particular room.

Corner luminaires, such as those described in FIGS. 1–3, can be part of a housing extending completely back into the corner through which discharge air from an air-conditioning system can pass, thereby removing the heat of the lamp or lamps with the simplest and smallest duct structures, that are significantly less expensive than prevailing systems.

In buildings without air-conditioning the surplus heat can be vented through an external wall with a small venting blower similar to those commonly used in diners and commercial kitchens. In winter, when heat indoors is needed, the same blower can be used with suitable ducting and dampering to shunt this heat down into the room, thereby reducing the heat which must be supplied by the normal heating system of the building.

A still simpler structure may involve a register placed in the ceiling directly above the corner luminaire to permit the heat to rise into a room above. In office buildings of many stories a duct or chimney can extend vertically through the entire building back of the corner luminaires, to serve as heat collector or heat disposer, depending on weather and climate. These remarkable advantages of the invention make practical the introduction of a degree of temperature control not otherwise available in some older buildings.

Both parabolic and elliptical reflecting cylinders are examples of satisfactory reflectors that are relatively easy to manufacture. For an elliptical reflector, it is preferred that the second focus of the ellipse be at or close beyond the far wall that is to be illuminated. By establishing this second focal point on the far wall, the total height of the illuminated band can be held to a smaller vertical dimension than if the reflector is a perfect parabola. It should be a relatively rare situation in which the room is so low that the perimeter band need be held to too small a height. In general, the front openings of the luminaires are likely to be in the range from 12 to 18 inches, and the vertical dimension of the upper wall white diffusing bands with typically be in a range from 18 to 24 inches or more.

There has been described a superior indoor indirect lighting system having numerous advantages over existing systems from the standpoint of economical diffuse uniform illumination while generating relatively little heat that may be relatively easily controlled in a desirable manner. The system may be advantageously employed in most rooms, large or small, such as in dwellings, schools, offices, drafting rooms, factories and stores. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Indirect room lighting apparatus comprising, reflecting means defining an elevated diffuse band around the top portion of walls of a room for reflecting light into the room below which band is on said walls and below the ceiling of said room, and illuminating means for illuminating said reflecting means with a beam of light energy characterized by a narrow vertical angle and broad horizontal angle to illuminate said reflecting means while directing negligible direct light energy in the region above and below said reflecting means.

2. Indirect room lighting apparatus in accordance with claim 1 wherein said illuminating means comprises, a luminaire in said room located at a height corresponding substantially to that of said reflecting means.

3. Indirect room lighting apparatus in accordance with claim 2 wherein said illuminating means comprises a luminaire located in a corner of said room.

4. Indirect room lighting apparatus in accordance with claim 3 wherein said luminaire comprises a reflecting surface having its axis at a 45° angle with respect to the walls of said room forming said corner.

5. Indirect room lighting apparatus in accordance with claim 4 wherein said luminaire comprises two lamps side by side.

6. Indirect room lighting apparatus in accordance with claim 3 wherein said luminaire comprises a pair of reflectors intersecting in said corner.

7. Indirect room lighting apparatus in accordance with claim 6 wherein said luminaire comprises a lamp at the intersection of the focal axes of said reflectors.

8. Indirect room lighting apparatus in accordance with claim 2 wherein said illuminating means comprises a luminaire having a lamp enclosed at least in part by a lens comprising at least a portion of a cylindrical surface.

9. Indirect room lighting apparatus in accordance with claim 8 wherein said lens comprises a cylindrical surface surrounding said lamp.

10. Indirect room lighting apparatus in accordance with claim 8 wherein said lens comprises a semicylindrical surface and further comprises a reflecting plane coacting with said lens to surround said lamp.

11. Indirect room lighting apparatus in accordance with claim 8 wherein said lens comprises a quarter of a cylindrical surface and further comprises, first and second orthogonal reflecting surfaces corresponding with said lens to surround said lamp.

12. Indirect room lighting apparatus in accordance with claim 8 wherein said lens comprises a semicylindrical surface and further comprises, a spherical mirror adjacent to said lamp for reflecting energy therefrom through said lens.

13. Indirect room lighting apparatus in accordance with claim 2 wherein said illuminating means comprises a luminaire having a reflector extending along more than half of one of said walls and having lamp means along the focus thereof for coacting with said reflector to provide said beam.

14. Indirect room lighting apparatus in accordance with claim 2 wherein said illuminating means comprises a luminaire having four contiguous reflectors in space quadrature about a light source for providing said beam.

* * * * *